US007137224B2

(12) United States Patent
Rasmussen et al.

(10) Patent No.: US 7,137,224 B2
(45) Date of Patent: Nov. 21, 2006

(54) VENTED SOFFIT PANEL AND METHOD FOR BUILDINGS AND LIKE

(75) Inventors: C. Scott Rasmussen, Ada, MI (US); Thomas A. McDonald, Grand Rapids, MI (US)

(73) Assignee: Quality Edge, Inc., Walker, MI (US)

( * ) Notice: Subject to any disclaimer, the term of this patent is extended or adjusted under 35 U.S.C. 154(b) by 270 days.

(21) Appl. No.: 10/778,507

(22) Filed: Feb. 16, 2004

(65) Prior Publication Data

US 2005/0178076 A1 Aug. 18, 2005

(51) Int. Cl.
*E04D 1/30* (2006.01)
*E04D 1/00* (2006.01)
*E04B 7/00* (2006.01)
*E04B 7/08* (2006.01)

(52) U.S. Cl. ..... 52/96; 52/94; 52/95; 52/302.1; 52/198; 52/199; 52/101

(58) Field of Classification Search ..... 52/94, 52/95, 96, 302.1, 198, 199, 101
See application file for complete search history.

(56) References Cited

U.S. PATENT DOCUMENTS

| | | | | | |
|---|---|---|---|---|---|
| 171,881 | A | * | 1/1876 | Yaarwood | 52/104 |
| 764,989 | A | * | 7/1904 | Chester | 52/450 |
| 3,256,654 | A | | 6/1966 | Pinckney, Jr. | |
| 3,417,519 | A | * | 12/1968 | Hitter | 52/11 |
| 3,496,691 | A | * | 2/1970 | Seaburg et al. | 52/336 |
| 3,724,149 | A | * | 4/1973 | Detman | 52/22 |
| 4,347,691 | A | | 9/1982 | Lloyd-Jones | |
| 4,607,753 | A | * | 8/1986 | Radek | 211/94.01 |
| 4,658,552 | A | * | 4/1987 | Mulford | 52/94 |
| 5,172,527 | A | * | 12/1992 | Ault | 52/145 |
| 5,195,283 | A | | 3/1993 | MacLeod et al. | |
| 5,243,793 | A | | 9/1993 | MacLeod et al. | |
| 5,718,086 | A | | 2/1998 | Dunn | |
| 5,728,000 | A | | 3/1998 | Bateman | |
| 5,937,592 | A | | 8/1999 | Tamlyn | |
| 5,941,028 | A | | 8/1999 | Hicks | |
| 6,112,490 | A | * | 9/2000 | Meyer | 52/407.3 |
| 6,145,255 | A | | 11/2000 | Allaster | |
| 6,223,488 | B1 | | 5/2001 | Pelfrey et al. | |
| 6,516,577 | B1 | | 2/2003 | Pelfrey et al. | |
| 6,913,530 | B1 | * | 7/2005 | Morris et al. | 454/365 |
| 6,941,707 | B1 | * | 9/2005 | Sigmund | 52/95 |
| 2002/0020125 | A1 | | 2/2002 | Pelfrey et al. | |
| 2002/0072324 | A1 | * | 6/2002 | Strait | 454/365 |
| 2002/0124484 | A1 | | 9/2002 | Martin | |
| 2004/0216397 | A1 | * | 11/2004 | Sigmund | 52/95 |

* cited by examiner

*Primary Examiner*—Carl D. Friedman
*Assistant Examiner*—Abdul Manaf
(74) *Attorney, Agent, or Firm*—Price, Heneveld, Cooper, DeWitt & Litton, LLP

(57) ABSTRACT

A vented soffit panel and related method for buildings and the like includes a generally flat imperforate base portion shaped to enclose at least a portion of the building soffit when mounted in a generally horizontal orientation under an eave. At least one vent channel protrudes upwardly from the base portion, and has a generally trapezoidal shape defined by a horizontal imperforate top wall and inclined perforate sidewalls with lower ends that connect with the base portion in a spaced apart relationship to define a slot through which air flows to vent the eave. The perforate sidewalls are disposed at an acute angle, such that they are hidden from view from a position underneath the eave.

47 Claims, 3 Drawing Sheets

VENTED SOFFIT PANEL AND METHOD FOR BUILDINGS AND LIKE

BACKGROUND OF THE INVENTION

The present invention relates to building construction, and in particular to a vented soffit panel and related method for buildings and the like.

Soffit panels are generally well-known in the art, and serve to cover or enclose the underside of the eaves of homes and other buildings of the type having roof eaves which extend beyond and hang over the outside walls of the building. The purpose of the soffit panels is to hide the eaves from view, and prevent the use of the underside of the eaves as a nesting place for insects, birds and the like. In modern day building construction, the soffit is normally vented to allow outside air to flow into the attic of the building to equalize the attic temperature and pressure with that of the outside environment. This equalization helps to prevent degradation of the roof, reduce moisture accumulation, and improve the heating and cooling efficiency for the building interior.

While some soffit panels are perforated or louvered to facilitate venting, they possess certain drawbacks. One such disadvantage is that insects, such as bees, bugs and the like, can get through the vents, and use the soffit as a nesting place. Debris can also become lodged in the vents to impede the free flow of air into the eave. Furthermore, such prior soffit panels normally have exposed or visible vents, thereby detracting from the overall appearance of the structure. Consequently, a soffit panel which overcomes these problems would be advantageous.

SUMMARY OF THE INVENTION

One aspect of the present invention is a vented soffit panel for buildings and the like, which includes a generally flat imperforate base portion shaped to enclose at least a portion of the building soffit when mounted in a generally horizontal orientation under an eave. At least one vent channel protrudes upwardly from the base portion, and has a generally trapezoidal shape defined by a horizontal imperforate top wall and inclined perforate sidewalls with lower ends that connect with the base portion in a spaced apart relationship to define a slot through which air flows to vent the eave. The perforate sidewalls are disposed at an acute angle, such that they are hidden from view from a position underneath the eave.

Another aspect of the present invention is a method for venting building roofs and the like of the type having at least one eave with a soffit thereunder. The method comprises forming a plurality of vented soffit panels, each having a generally flat imperforate base portion shaped to enclose at least a portion of the soffit when mounted in a generally horizontal orientation under the eave, and at least one vent channel portion extending along the base portion, and protruding upwardly therefrom, wherein the vent channel portion has a generally trapezoidal lateral cross-sectional shape defined by a generally horizontal imperforate top wall and inclined perforate sidewalls with lower ends connected with the base portion in a mutually spaced apart relationship to define a slot therebetween through which ambient air enters into the vent channel and flows through the perforate sidewalls to vent the eave, wherein the perforate sidewalls are disposed at a predetermined acute angle relative to the top wall and the base portion. The method further includes installing the soffit panels in a side-by-side, generally horizontal position under the eave, such that the eave is enclosed, and the perforate sidewalls of the vented soffit panels are hidden from view from a position underneath the eave.

Yet another aspect of the present invention is a vented soffit panel which has a hidden venting structure for improved aesthetics, yet prevents insects, bugs and other debris from entering the soffit or eave. The vented soffit panel has an uncomplicated design, is easy to install, and economical to manufacture. Preferably, the vented soffit panel is constructed from roll formed aluminum or the like to provide a very lightweight, yet durable, product.

These and other advantages of the invention will be further understood and appreciated by those skilled in the art by reference to the following written specification, claims, and appended drawings.

DETAILED DESCRIPTION OF THE PREFERRED EMBODIMENTS

Figure 1:
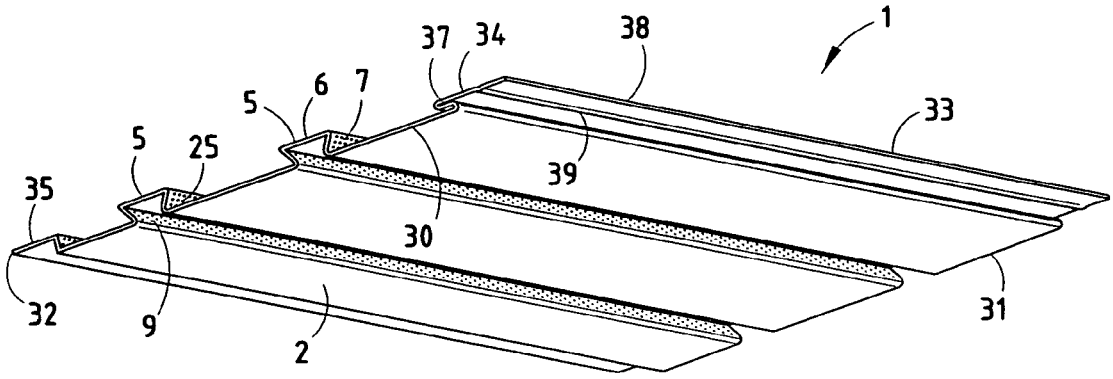
FIG. 1 is a perspective view of a vented soffit panel embodying the present invention.

For purposes of description herein, the terms "upper", "lower", "right", "left", "rear", "front", "vertical", "horizontal", and derivatives thereof shall relate to the invention as oriented in FIG. 1, and installed in a generally horizontal orientation under an associated eave. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a vented soffit panel embodying the present invention. In the illustrated example, vented soffit panel 1 includes a generally flat imperforate base portion 2 shaped to enclose at least a portion of the building soffit 3 (FIG. 8) when mounted in a generally horizontal orientation under an eave 4. At least one vent channel 5 (FIGS. 1–3) protrudes upwardly from the base portion 2, and has a generally trapezoidal shape defined by a horizontal imperforate top wall 6, and inclined perforate sidewalls 7 with lower ends 8 that connect with base portion 2 in a spaced apart relationship to define a slot 9 through which air flows to vent eave 4. The perforate sidewalls 7 are disposed at an acute angle relative to top wall 6 and base portion 2, such that they are hidden from view from a position underneath eave 4.

Figure 8:
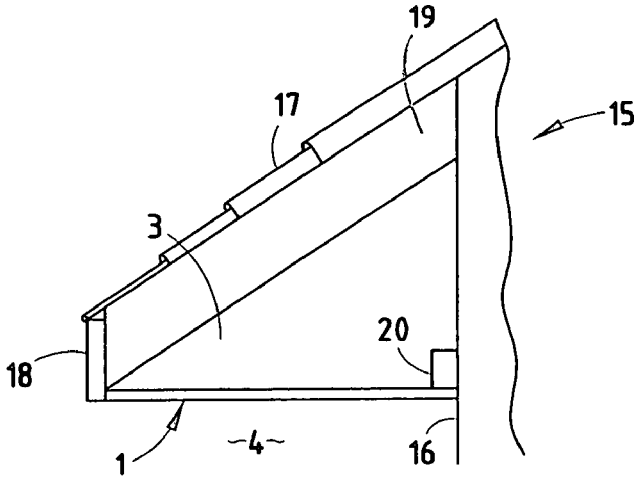
FIG. 8 is a partially schematic view of a roof eave with the soffit panel installed therein.

In the example illustrated in FIG. 8, building 15 has a substantially conventional construction, comprising an exterior wall 16 and an inclined roof 17 which protrudes over exterior wall 16 to define eave 4. A fascia board 18 extends along the lower edge of roof 17, and depends downwardly therefrom, and is typically fastened to the ends of the rafters 19. A ledger board 20 is attached to the exterior wall 16 of building 15 at a location generally horizontally aligned with the bottom of fascia board 18. Vented soffit panels 1 are positioned in a side-by-side relationship beneath the overhang or eave 4, and extend from fascia board 18 to ledger board 20 to enclose the underside of eave 4 and define soffit 3, which communicates with the attic (not shown) of building 15.

Figure 3:
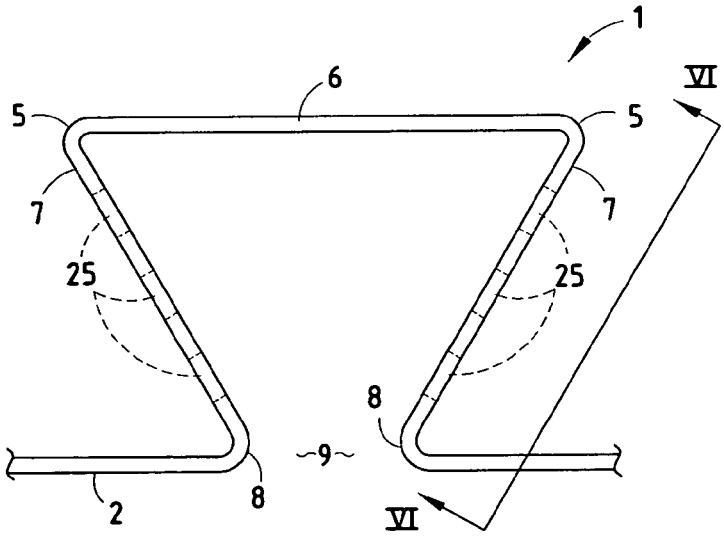
FIG. 3 is an enlarged, fragmentary, vertical cross-sectional view of the soffit panel, showing a vent channel portion thereof.
Figure 4:
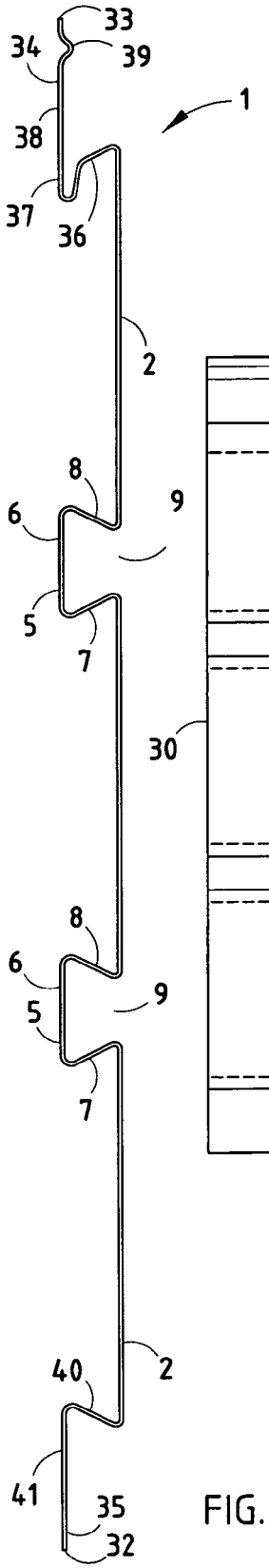
FIG. 4 is an end view of the vented soffit panel.
Figure 5:
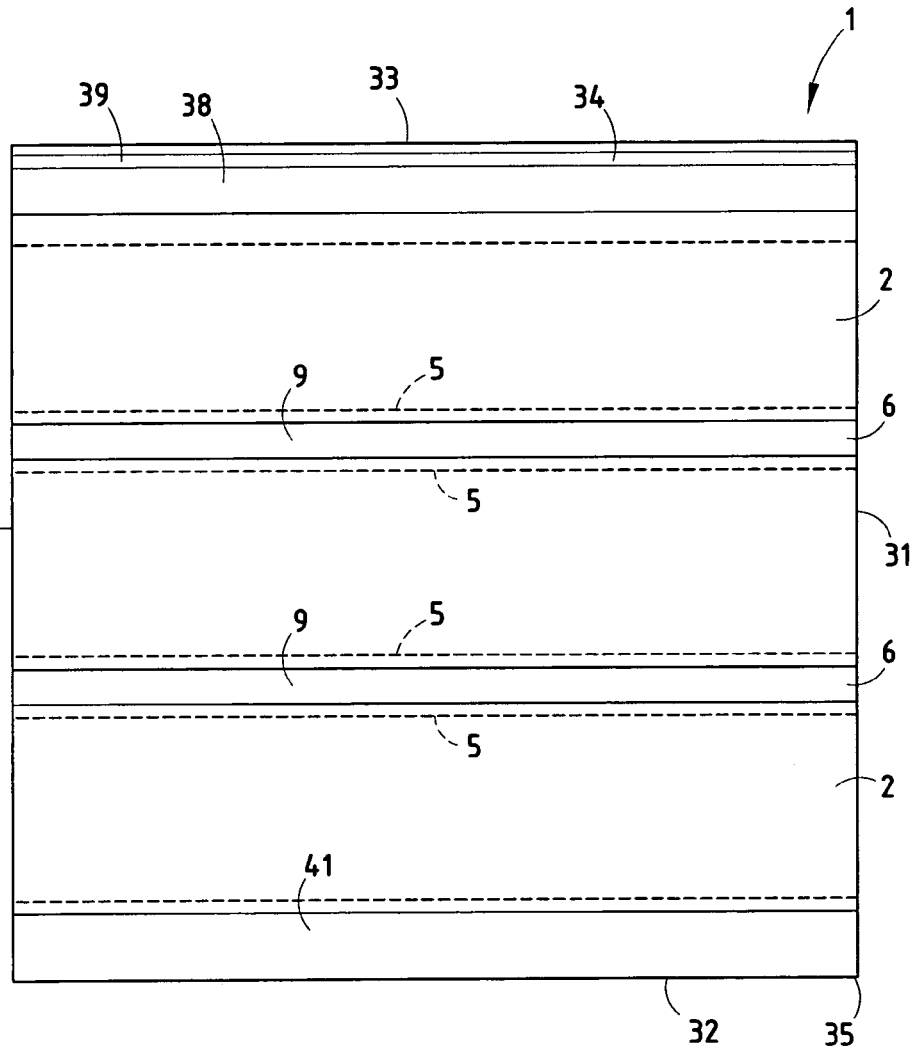
FIG. 5 is a bottom plan view of the vented soffit panel.
Figure 7:
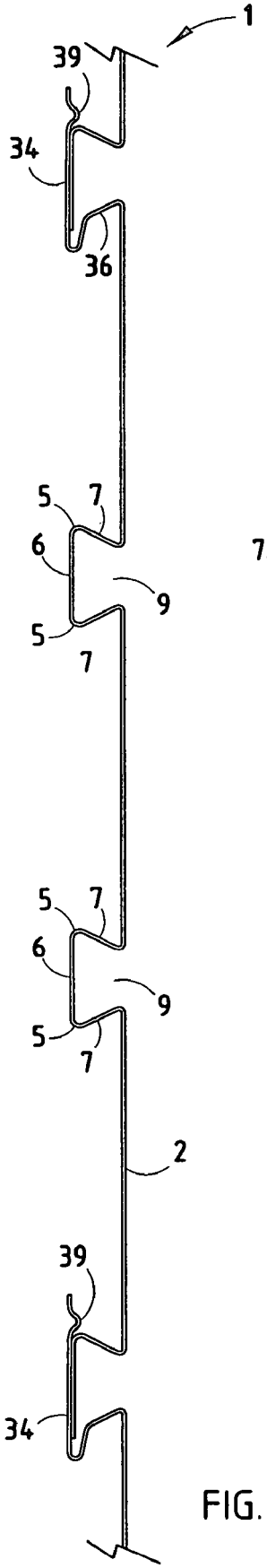
FIG. 7 is a front elevational view of a plurality of soffit panels interconnected along opposite edges.

In the illustrated example, vented soffit panel 1 preferably has an integrally formed, one-piece construction, and can be made from metal, such as aluminum or the like, as well as synthetic materials, such as vinyl. As best illustrated in FIG. 3, sidewalls 7 are oriented at a predetermined acute angle with respect to both base portion 2 and top wall 6. Preferably, the predetermined acute angle of sidewalls 7 is in the range of 20 to 70 degrees. The illustrated sidewalls 7 are disposed at a predetermined acute angle of approximately 60 degrees. The illustrated sidewalls 7 are substantially identical in size and oriented at a similar angle with respect to base portion 2 and top wall 6, so as to define a generally regular trapezoidal shape.

Figure 2:
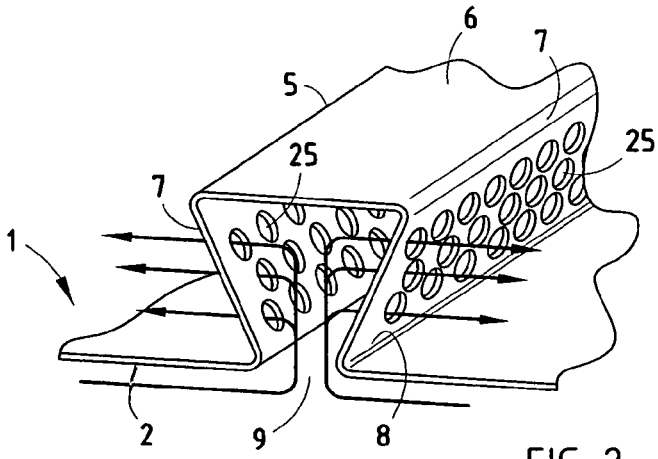
FIG. 2 is an enlarged, fragmentary view of the soffit panel, showing airflow therethrough.

In the example illustrated in FIGS. 1–3, the top wall 6 of vent channel 5 is substantially imperforate, and therefore does not permit air to pass therethrough. Top wall 6 does not have any visually detectable openings or apertures, but rather has an appearance substantially identical with the exterior surface of base portion 2, such that the same match. Top wall 6 is disposed in a generally horizontal orientation when vented soffit panel 1 is installed under an eave 4.

Figure 6:
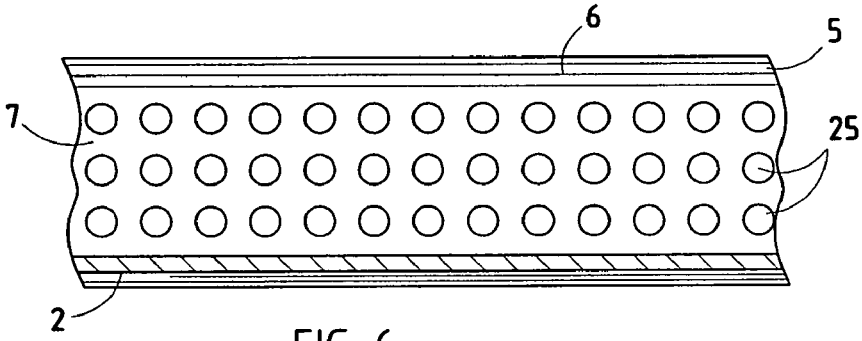
FIG. 6 is a cross-sectional view of the vented soffit panel, taken the along the line VI—VI, FIG. 4.

In the example illustrated in FIGS. 1–3, each of the sidewalls 7 is perforate, and therefore permits air to pass therethrough. The illustrated sidewalls 7 include a plurality of apertures 25, which have a generally circular plan shape, and are oriented perpendicularly with respect to the associated sidewalls 7. Apertures 25 are sized to permit ambient air to flow freely through sidewalls 7, yet prevent bugs and other debris from entering soffit 3. Preferably, apertures 25 have a diameter in the range of 0.080 to 0.100 inches, and in the illustrated example have a diameter of around 0.094 inches. The illustrated apertures 25 are arranged in a plurality of mutually staggered rows, which provide around 21 apertures 25 per running inch in the orientation illustrated in FIG. 6.

As will be apparent to those skilled in the art, while the illustrated soffit panel 1 has a plurality of circular apertures 25 in sidewalls 7 to render the same perforate, sidewalls 7 may be equipped with other forms of vents, such as elongate slits, rectangular windows, and the like, to permit air to pass therethrough.

With reference to FIGS. 4–7, the illustrated vented soffit panel 1 has a substantially rectangular plan configuration, defined by a front edge 30, a rear edge 31, and opposing side edges 32 and 33. The illustrated vented soffit panel 1 also includes a plurality of vent channels 5 extending along the depth of base portion 2. More specifically, the vented soffit panel 1 illustrated in FIGS. 4–7 includes two vent channels 5, which extend along the depth of vented soffit panel 1 in a mutually spaced apart relationship at a medial portion of base portion 2. Furthermore, vented soffit panel 1 includes connector flanges 34 and 35, which extend along the side edges 33 and 32 respectively of vented soffit panel 1. Connector flange 34 includes an inclined sidewall 36, whose shape, size, and orientation are substantially identical to the sidewalls 7 of vent channel 5. Connector flange 34 also includes a narrow receptor slot 37, formed by overlapping portions of connector flange 34, which is shaped to receive therein the connector flange 35 of an adjacent vented soffit panel 1, in the manner illustrated in FIG. 7. The top wall 38 of connector flange 34 is coplanar with the top wall 6 of vent channel 5, and includes a downwardly oriented protrusion or detent 39 adjacent the free end thereof which is adapted to abut and frictionally engage the connector flange 35 of the next adjacent vented soffit panel 1 to securely interconnect the same in a side-by-side relationship. The sidewall 36 of connector flange 35 may also be perforated in a manner similar to the sidewall 7 of vent channel 5 to provide additional venting. Connector flange 35 also includes an inclined sidewall 40, which is similar in shape, size, and orientation to sidewalls 7 of vent channel 5, as well as the sidewall 36 of connector flange 34, and may also be provided with perforations for additional venting. The top wall 41 of connector flange 35 is also coplanar with the top wall 6 of vent channels 5.

In one working embodiment of the present invention, elongate sheets of aluminum having a length of around 12 feet and a width of around 13–14 inches are roll formed into the shape illustrated in FIG. 1, and then cut lengthwise into segments having a length equal to the depth of the eave to be covered. For example, the vented soffit panel 1 shown in FIG. 1 has a depth, as measured between edges 30 and 31, in the range of 12–36 inches, and a width, as measured between side edges 32 and 33, of approximately 13¼ inches. The height of vent channel 5, as measured between base portion 2 and top wall 6, is around 0.46 inches, while the width of slot 9, as measured between the lower ends 8 of adjacent sidewalls 7, is around 0.26 inches. Vent channels 5, as well connector flanges 34 and 35, are spaced apart on four inch centers, and the staggered rows of apertures are spaced apart around 0.13 inches.

Vented soffit panels 1 are installed under the eave 4 of building roof 17 in the following manner. The rear edge 31 of each vented soffit panel 1 is positioned along ledger board 20, with vent channels 5 oriented upwardly. The front edge 30 of each vented soffit panel 1 is positioned along the interior surface of fascia board 18, and may be attached to the same, as well as to the lower surfaces of rafters 19. Vented soffit panels 1 are arranged in a side-by-side fashion, with the connector flange 35 of each soffit panel 1 being inserted into the connector flange 34 of the next adjacent soffit panel, so as to interconnect the same in a substantially flat or planar condition. When vented soffit panels 1 are so installed, the perforate sidewalls 7 of vent channels 5, and/or sidewalls 36 and 40 of connector flanges 34 and 35 are concealed or hidden from view from a position underneath the eave. The angular orientation of sidewalls 7, in combination with the size of slot 9, prevents apertures 25 from being seen from a position underneath the eave, so as to greatly improve the aesthetics of the building construction.

Vented soffit panel 1 thereby provides improved aesthetics by hiding from view apertures 25 and/or other perforate structures to permit air to flow therethrough. Yet, vented soffit panel 1 prevents insects, bugs, and other debris from entering the soffit 3 or eave 4. The vented soffit panel 1 has an uncomplicated design, is easy to install, economical to manufacture, and very durable.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A vented soffit panel for building roofs and the like of the type having at least one eave with a soffit thereunder; comprising:

a generally flat, imperforate base portion shaped to enclose at least a portion of the soffit when mounted in a generally horizontal orientation under the eave; and at least one vent channel portion extending along said base portion, and protruding upwardly therefrom; said vent channel portion having a generally trapezoidal lateral cross-sectional shape defined by a generally horizontal imperforate top wall and inclined perforate sidewalls with lower ends thereof connected with said base portion in a mutually spaced apart relationship to define a slot therebetween through which ambient air enters into said vent channel and flows through said perforate sidewalls to vent the eave; said perforate sidewalls being disposed at a predetermined acute angle relative to said top wall and said base portion, whereby when said soffit panel is installed in said generally horizontal orientation, said perforate sidewalls are hidden from view from a position underneath the eave.

2. A vented soffit panel as set forth in claim 1, wherein:

said predetermined acute angle of said perforate sidewalls is in the range of 20–70 degrees.

3. A vented soffit as set forth in claim 2, wherein:

said predetermined acute angle of said perforate sidewalls is less than 60 degrees.

4. A vented soffit panel as set forth in claim 3, wherein:

said predetermined acute angle of each of said perforate sidewalls is substantially identical such that said trapezoidal shape is generally regular.

5. A vented soffit panel as set forth in claim 4, wherein:

said predetermined acute angle of each of said perforate sidewalls is around 60 degrees.

6. A vented soffit panel as set forth in claim 5, wherein:

said slot has a predetermined width in the range of 0.125–0.750 inches.

7. A vented soffit panel as set forth in claim 6, wherein:

said predetermined width of said slot is in the range of 0.20–0.30 inches.

8. A vented soffit panel as set forth in claim 7, wherein:

said predetermined width of said slot is around 0.26 inches.

9. A vented soffit panel as set forth in claim 8, wherein:

said perforate sidewalls include a plurality of apertures extending laterally therethrough.

10. A vented soffit panel as set forth in claim 9, wherein:

said apertures have a generally circular plan shape.

11. A vented soffit panel as set forth in claim 10, wherein:

said apertures are sized to permit ambient air to flow freely therethrough, yet prevent bugs and debris from entering the soffit.

12. A vented soffit panel as set forth in claim 11, wherein:

said apertures have a diameter in the range of 0.080–0.100 inches.

13. A vented soffit panel as set forth in claim 12, wherein:

said apertures have a diameter of around 0.094 inches.

14. A vented soffit panel as set forth in claim 13, wherein:

said perforate sidewalls each have around 21 of said apertures per inch.

15. A vented soffit panel as set forth in claim 5, wherein:

said apertures are arranged in a plurality of mutually staggered rows.

16. A vented soffit panel as set forth in claim 15, wherein:

said base portion includes opposed end edges defining a predetermined width therebetween which is substantially commensurate with the width of the soffit to fully enclose the same; and wherein:

said vent channel extends along said predetermined width of said soffit panel.

17. A vented soffit panel as set forth in claim 16, wherein:

said vent channel extends continuously along the entire width of said base portion in a generally parallel relationship with said opposed end edges.

18. A vented soffit panel as set forth in claim 17, including:

a plurality of said vent channels extending across the width of said base portion in a mutually parallel relationship.

19. A vented soffit panel as set forth in claim 18, wherein:

said base portion includes opposed side edges with flanges shaped for connection with like flanges of an adjacent one of said vented soffit panels to fully enclose the soffit.

20. A vented soffit panel as set forth in claim 19, wherein:

said base portion and said vent channels are integrally formed to provide a one-piece construction.

21. A vented soffit panel as set forth in claim 20, wherein:

said vented soffit panel is constructed from roll formed aluminum.

22. A vented soffit panel as set forth in claim 21, wherein:

said apertures have central axes disposed generally perpendicular to the associated one of said perforate sidewalls.

23. A vented soffit as set forth in claim 22, wherein:

said imperforate top wall is spaced apart from said base portion a distance in the range of 0.40–0.50 inches.

24. A vented soffit panel as set forth in claim 1, wherein:

said predetermined acute angle of each of said perforate sidewalls is substantially identical such that said trapezoidal shape is generally regular.

25. A vented soffit panel as set forth in claim 1, wherein:

said predetermined acute angle of each of said perforate sidewalls is around 60 degrees.

26. A vented soffit panel as set forth in claim 1, wherein:

said slot has a predetermined width in the range of 0.125–0.750 inches.

27. A vented soffit panel as set forth in claim 1, wherein:

said predetermined width of said slot is in the range of 0.20–0.30 inches.

28. A vented soffit panel as set forth in claim 1, wherein:

said predetermined width of said slot is around 0.26 inches.

29. A vented soffit panel as set forth in claim 1, wherein:

said perforate sidewalls include a plurality of apertures extending laterally therethrough.

30. A vented soffit panel as set forth in claim 29, wherein:

said apertures have a generally circular plan shape.

31. A vented soffit panel as set forth in claim 29, wherein:

said apertures are sized to permit ambient air to flow freely therethrough, yet prevent bugs and debris from entering the soffit.

32. A vented soffit panel as set forth in claim 29, wherein:

said apertures have a diameter in the range of 0.080–0.100 inches.

33. A vented soffit panel as set forth in claim 29, wherein:

said apertures have a diameter of around 0.094 inches.

34. A vented soffit panel as set forth in claim 29, wherein:

said perforate sidewalls each have around 21 of said apertures per inch.

35. A vented soffit panel as set forth in claim 29, wherein:

said apertures are arranged in a plurality of mutually staggered rows.

36. A vented soffit panel as set forth in claim 1, wherein:

said base portion includes opposed end edges defining a predetermined width therebetween which is substantially commensurate with the width of the soffit to fully enclose the same; and wherein:

said vent channel extends along said predetermined width of said soffit panel.

37. A vented soffit panel as set forth in claim 1, including:

a plurality of said vent channels extending across the width of said base portion in a mutually parallel relationship.

38. A vented soffit panel as set forth in claim 1, wherein:

said base portion includes opposed side edges with flanges shaped for connection with like flanges of an adjacent one of said vented soffit panels to fully enclose the soffit.

39. A vented soffit panel as set forth in claim 1, wherein:

said base portion and said vent channels are integrally formed to provide a one-piece construction.

40. A vented soffit panel as set forth in claim 1, wherein:

said vented soffit panel is constructed from roll formed aluminum.

41. A vented soffit panel as set forth in claim 30, wherein:

said apertures have central axes disposed generally perpendicular to the associated one of said perforate sidewalls.

42. In a method for venting building roofs and the like of the type having at least one eave with a soffit defined thereunder, the improvement comprising:

forming a plurality of vented soffit panels, each having a generally flat, imperforate base portion shaped to enclose at least a portion of the soffit when mounted in a generally horizontal orientation under the eave, and at least one vent channel portion extending along said base portion, and protruding upwardly therefrom, wherein the vent channel portion has a generally trapezoidal lateral cross-sectional shape defined by a generally horizontal imperforate top wall and inclined perforate sidewalls with lower ends thereof connected with said base portion in a mutually spaced apart relationship to define a slot therebetween through which ambient air enters into said vent channel and flows through said perforate sidewalls to vent the eave and the perforate sidewalls are disposed at a predetermined acute angle relative to said top wall and said base portion; and installing the soffit panels in a side-by-side, generally horizontal position under the eave, such that the eave is enclosed, and the perforate sidewalls are hidden from view from a position underneath the eave.

43. A method as set forth in claim 42, wherein:

said forming step includes forming the predetermined acute angle of the perforate sidewalls in a range of 20–70 degrees.

44. A method as set forth in claim 43, wherein:

said forming step includes forming the predetermined acute angle of the perforate sidewalls at less than 65 degrees.

45. A method as set forth in claim 44, wherein:

said forming step includes forming the slot with a predetermined width in the range of 0.125–0.750 inches.

46. A method as set forth in claim 45, wherein:

said forming step includes forming the perforate sidewalls with a plurality of apertures extending laterally therethrough.

47. A method as set forth in claim 46, wherein:

said forming step includes roll forming each of the soffit panels from sheet aluminum.

* * * * *